US006107737A

United States Patent [19]

della Porta

[11] Patent Number: 6,107,737

[45] **Date of Patent: *Aug. 22, 2000**

[54] DEVICE FOR DISPENSING MERCURY, SORBING REACTIVE GASES, SHIELDING ELECTRODES IN FLUORESCENT LAMPS AND A PROCESS FOR MAKING SUCH DEVICE

[75] Inventor: Massimo della Porta, Milan, Italy

[73] Assignee: Saes Getters, S.p.A., Milan, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,724

[22] Filed: Nov. 21, 1996

[30] Foreign Application Priority Data

Nov. 23, 1995 [IT] Italy ..... MI95A2435

[51] Int. Cl.[7] ..... H01J 17/24; H01J 19/70; H01J 61/26; H01J 17/26

[52] U.S. Cl. ..... 313/556; 313/558; 313/559; 313/560; 313/566; 313/491; 313/493; 313/631; 313/634

[58] Field of Search ..... 313/264, 491–93, 313/548–566, 631–32, 634–35, 574

[56] References Cited

U.S. PATENT DOCUMENTS

| | | | |
|---|---|---|---|
| 3,203,901 | 8/1965 | Della Porta | 252/181.6 |
| 3,525,009 | 8/1970 | Someya et al. | 313/559 |
| 3,657,589 | 4/1972 | Della Porta et al. | 313/556 |
| 3,663,855 | 5/1972 | Boettcher | 313/566 |
| 4,032,813 | 6/1977 | Shurgan et al. | 313/492 |
| 4,306,887 | 12/1981 | Barosi et al. | 55/68 |
| 4,308,650 | 1/1982 | Hernandez et al. | 313/492 X |
| 4,312,669 | 1/1982 | Boffito et al. | 75/177 |
| 4,549,251 | 10/1985 | Chapman et al. | 313/264 X |
| 4,754,193 | 6/1988 | Holmes et al. | 313/490 |
| 4,808,136 | 2/1989 | Schuster | 445/9 |
| 4,823,047 | 4/1989 | Holmes et al. | 313/546 |
| 4,990,828 | 2/1991 | Rabusin | 313/556 X |
| 5,754,000 | 5/1998 | Skilton et al. | 313/556 X |
| 5,825,127 | 10/1998 | Weinhardt . | |
| 5,838,104 | 11/1998 | Rutan et al. | 313/560 |

FOREIGN PATENT DOCUMENTS

| | | |
|---|---|---|
| 0 568 317 A1 | 11/1993 | European Pat. Off. . |
| 0 669 639 A1 | 8/1995 | European Pat. Off. . |
| 0 691 670 A2 | 1/1996 | European Pat. Off. . |

OTHER PUBLICATIONS

Della Porta P et al.; "Mercury Dispensing And Gettering In Flourescent Lamps,"Mar. 25, 1974, Japanese Journal of Applied Physics, Supplements, vol. Suppl. 2, pp. 45–48.

*Primary Examiner*—Nimeshkumar D. Patel
*Assistant Examiner*—Mack Haynes
*Attorney, Agent, or Firm*—Hickman Stephens Coleman & Hughes, LLP

[57] ABSTRACT

A mercury dispensing support strip capable of dispensing mercury and sorbing reactive gases. In one embodiment, the support strip of the invention includes at least one track of mercury releasing material deposited on one face of the support strip. At least one track of getter material is also deposited on the same face of the support strip. The tracks of mercury releasing and getter materials are deposited on the support strip such that the mechanical strains exerted by the materials on points of the support strip that are substantially symmetric with respect to a central axis of said first surface of said mercury dispensing support strip are substantially equivalent.

27 Claims, 4 Drawing Sheets

DEVICE FOR DISPENSING MERCURY, SORBING REACTIVE GASES, SHIELDING ELECTRODES IN FLUORESCENT LAMPS AND A PROCESS FOR MAKING SUCH DEVICE

CLAIM FOREIGN PRIORITY UNDER 35 U.S.C. § 119

This patent application claims priority under 35 U.S.C. § 119 from Italian Patent Application Ser. No. MI 95/A 002435, filed Nov. 23, 1995.

CROSS REFERENCE TO RELATED APPLICATIONS

The material disclosed in this patent application is related to U.S. patent application Ser. No. 08/760,244 (Attorney Docket No. SAESP029) which is incorporated herein by reference in its entirety and for all purposes.

BACKGROUND OF THE INVENTION

The present invention relates to devices for dispensing measured amounts of mercury and sorbing certain gases. More particularly, the present invention relates to devices for dispensing mercury, sorbing reactive gases, shielding electrodes in fluorescent lamps, and processes for making such devices.

A fluorescent lamp typically includes a glass tube which may be either rectilinear or circular depending on the type of lamp employed. The inner surface of the glass tube is generally lined with powders of fluorescent materials, known as phosphors, which are responsible for the emission of visible light when activated. The tube is typically filled with a rare gas, such as argon or neon, including small quantities of mercury vapors, i.e., quantities on the order of a few milligrams (mg). Two electrodes functioning as cathodes are formed inside the tube by placing metal wires, for example, at both ends of the tube in the rectilinear lamp or in a given zone in the circular lamp.

When the lamp is energized, a potential difference between the two electrodes generates an electronic emission and strikes a plasma inside the tube. It is believed that the plasma contains free electrons and ions of the rare gas, which propel the mercury atoms to a higher excitation state and cause the emission of UV radiation. The phosphors absorb the UV radiation emitted by the mercury atoms and through the fluorescence phenomenon emit visible light. Mercury, therefore is an integral component in the effective operation of the lamp.

Mercury is typically provided in the lamp in a minimum quantity, below which the lamp does not work. It is undesirable to employ mercury in quantities greater than the necessary minimum as the disposal of toxic mercury at the end of the life of the lamp, e.g., due to breakage, etc., poses serious health and environmental problems. Thus, it is important to provide mercury inside the lamp in extremely precise quantities and a reproducible manner. However, this may be particularly complicated because the variety of lamps appearing on the market, having different shapes, sizes and component materials, has significantly increased and the quantity of mercury required for lamp operation varies from lamp to lamp.

Conventional methods of providing mercury in its liquid state has not proved to be reliable, due in part to the difficulty in providing precise and reproducible volumes of liquid mercury in the range of a few microliters ($\mu$l) and the uncontrolled diffusion of mercury vapors in the working area. As a result, various other methods have been proposed as alternatives to the conventional method of providing liquid mercury.

One such alternative includes the use of amalgams containing elements such as zinc to provide mercury in the lamps during the lamp assembly process. However, these amalgams tend to release mercury at the relatively low temperatures of about 100° C. The release of mercury becomes especially serious during the lamp manufacturing process when the lamp is open and exposed to high temperatures, as mercury is then released into the manufacturing environment posing health and contamination threats to those in the production area.

Another alternative to the conventional method of providing mercury includes the use of capsules containing liquid mercury as suggested by U.S. Pat. Nos. 4,823,047 and 4,754,193. This method of providing mercury, however, is also unreliable for similar reasons described above. Furthermore, it is also difficult to manufacture capsules in small sizes that are necessary for many lamp designs. The alternative use of pellets or pills of porous materials soaked with liquid mercury, as suggested by U.S. Pat. Nos. 4,808,136 and EP-A-568317, has also not been found to be an effective method for providing mercury in the lamp because the positioning of the pellets in the lamp is an extremely arduous and a time-consuming task.

As a further example of an alternative method of providing mercury in the lamp, U.S. Pat. No. 3,657,589 discloses the use of intermetallic compounds of mercury with titanium and/or zirconium for providing precise quantities of mercury in lamps. The intermetallic compounds are well suited for providing mercury because they are stable at high temperatures, e.g., about 500° C., generally encountered during the manufacturing process of the lamps. One such material, $Ti_3Hg$, is commercially available from SAES GETTERS S.p.A. of Lainate (Milano), Italy, under the tradename St 505. According to U.S. Pat. No. 3,657,589, the St 505 compound can be introduced into the lamp both in free form, such as compressed powders, or in supported form, e.g., as powder pressed on an open container or supported on a metallic strip. The supported form is particularly appreciated by the manufacturers of lamps because the strip carrying the mercury dispensing material can be closed as a ring, which simultaneously functions as an electrode shielding member.

After the lamp is assembled and sealed, the St 505 compound typically undergoes an activation treatment step, which includes heating the compound by radio frequency (RF) waves produced by an external coil for about 30 seconds at temperatures of about 900° C., to release mercury. The mercury yield of these compounds during activation is less than 50% and the remaining mercury is slowly released during the life of the lamp. European Patent Application Nos. 95830046.9 (EP-A-0669639) and 95830284.6 (EP-A-0691670) suggest mixing the above-mentioned mercury intermetallic compounds with promoting alloys, such as copper-tin and copper-silicon alloys. The promoting alloys facilitate the release of mercury from the intermetallic compound during the activation step, and thereby shorten heating times or lower temperatures during activation.

The operation of a fluorescent lamp is also significantly impaired by the presence of reactive gases inside the lamp. By way of example, hydrogen ($H_2$) interacts with a fraction of the electrons emitted during the decomposition of the rare gas and thereby increases the minimum voltage required to switch on the lamp. Other examples of reactive gases that impair the lamp's operation include: oxygen ($O_2$) and water ($H_2O$), which undesirably remove mercury by producing mercury oxide; and carbon oxides, such as carbon monoxide (CO) and carbon dioxide ($CO_2$), which decompose when they come in contact with the electrodes to form oxygen ($O_2$), (which removes mercury as mentioned above) and carbon (C), which deposits on the phosphors to create dark zones in the lamp. In order for the lamps to function effectively, it is important, therefore, to remove such reactive gases by providing means for sorbing reactive gases inside the lamps.

To this end, EP-A-0669639 and EP-A-0691670 suggest adding powders of a getter material to the powders of the mercury releasing material to facilitate the sorption of the above-mentioned reactive gases. The getter material most commonly employed is an alloy having percent composition by weight of 84% Zr, 16% Al, available commercially from SAES GETTERS S.p.A. of Lainate (Milano), Italy, under the tradename St 101. Other suitable getter alloys include alloys having the following percent compositions by weight: 70% Zr; 24.6% V; 5.4% Fe and 76.6% Zr; 23.4% Fe, also available from SAES GETTERS S.p.A. of Lainate (Milano), Italy, under the tradename St 707 and St 198, respectively.

To this end, a "shield" including metallic support strips placed co-axially in the lamp, is also provided to prevent blackening of the phosphors in the electrode areas. The shield includes both the getter material and the mercury releasing material deposited directly on the shielding members surrounding the electrodes. One such shield configuration is described in U.S. Pat. No. 3,657,589.

However, when the above-described copper-based promoting alloys are employed with a shield as described above, it is not possible to mix the getter material with the mercury releasing material as the copper-based alloys melt and at least partially coat the getter surface at temperatures required to activate the release of mercury from the mercury releasing material. Consequently, this impedes the ability of the getter to effectively sorb reactive gases. It is, therefore, preferable to keep the getter material separated from the mercury releasing material when promoting alloys are employed in the lamp. This can be accomplished by depositing separate tracks of powdered mercury releasing material and powdered getter on a strip-shaped support. In this context, the above-mentioned European patent applications suggest the possibility of depositing the two powders on the opposite sides of the support strip by cold rolling. According to this technique, the cold support strip and powders are positioned appropriately and passed through pressure rollers to form tracks of powder on the opposite sides of the same strip.

Unfortunately, this process suffers from several drawbacks. By way of example, it is difficult in practice to carry out the deposition on the opposite sides of the support strip. In particular, it is difficult to pass the support strip vertically between two rollers positioned on the opposite sides of the support strip, while pouring two different powders on the opposite sides in a single working step. There is also a potential risk that the first deposit track may be removed or somehow altered during a second rolling step when the deposition is being carried out on the opposite sides in two distinct passages. As the strip is bent to produce a shield, there is a potential risk of removing the powder deposition from the strip, particularly from the concave region of the bent strip. Furthermore, rolling different powders having different hardness induce mechanical strains of varying intensities, which if not balanced may ultimately deform the strip, e.g., the strip may stretch along one of its sides, resulting in lateral bending or "sabre-blade" shaping.

Thus, it would be advantageous to provide a mercury dispensing device that can effectively sorb reactive gases and shield electrodes in a fluorescent lamp without suffering from the prior art drawbacks, e.g., poor getter performance and lateral bending or "sabre-blade" shaping.

SUMMARY OF THE INVENTION

To achieve the foregoing, the present invention provides a device for dispensing mercury, sorbing reactive gases, electrode shielding in fluorescent lamps, and a process of making the device thereof.

In one aspect, the present invention provides a mercury dispensing support strip capable of dispensing mercury and sorbing reactive gases. In one embodiment, the support strip of the invention includes at least one track of mercury releasing material deposited on one face of the support strip. At least one track of getter material is also deposited on the same face of the support strip. The tracks of mercury releasing and getter materials are deposited on the support strip such that the mechanical strains exerted by the materials on points of the support strip that are substantially symmetric with respect to a central axis of said first surface of said mercury dispensing support strip are substantially equivalent.

In one embodiment, the mechanical strains exerted by the materials do not differ by more than about 15%. In another embodiment, the hardness of the materials is chosen such that, the mechanical strains exerted by the materials do not differ by more than about 15%. In still another embodiment, the surface of the support strip includes longitudinal channels that are adapted to receive the getter and mercury releasing materials. In yet another embodiment, the opposing face of the support strip includes longitudinal deformations to designate bending regions of the support strip.

In some embodiment, the mercury releasing materials are intermetallic compounds of mercury and copper based promoting alloys. More particular mercury dispensing materials include titanium based intermetallic compounds and zirconium based intermetallic compounds. The copper based promoting alloys can include one or more alloys from the group consisting of copper silicon alloys and copper-tin alloys. One particular titanium based compound is $Ti_3Hg$. In some embodiments, the getter material comprises one or more alloys selected from the group consisting of alloys having compositions including about 84% Zr-16% Al, alloys having compositions including about 70% Zr-24.6% V-5.4% Fe and alloys having compositions including about 76.6% Zr-23.4% Fe percent composition is by weight.

In another aspect, the present invention provides a process manufacturing a mercury dispensing support strip capable of dispensing mercury and sorbing gases. In one embodiment, the process of the invention includes the steps of depositing at least one track of a mercury releasing material and at least one track of a getter material on a surface of a mercury dispensing support strip by cold rolling the mercury releasing and getter materials thereon under conditions such that the tracks of the mercury releasing and getter materials exert substantially equal mechanical strains on points of said mercury dispensing support strip that are substantially symmetric with respect to the central axis of the support strip. In one embodiment, the mechanical strains produced by the mercury releasing and getter materials differ by no more than about 15%.

In still another aspect, the present invention provides a mercury dispensing shield effective to dispense mercury and sorb reactive gases in a fluorescent lamp. In one embodiment, the shield of the invention includes a ring shaped support including a first surface having a central axis. Deposited on the support are at least one track of a mercury dispensing material and at least one track of a getter material such that the mercury releasing and getter materials exert substantially equal mechanical strains on points of said mercury dispensing support strip that are substantially symmetric with respect to the central axis of the support.

These and other features of the present invention will be described in more detail below in the detailed description of the invention and in conjunction with the following figures.

DETAILED DESCRIPTION OF THE PREFERRED EMBODIMENTS

The present invention includes a device for dispensing mercury, sorbing reactive gases, and shielding electrodes in fluorescent lamps, in addition to a process of making such a device. In the following description, numerous specific details are set forth in order to provide an understanding of the present invention. It will be apparent, however, to one skilled in the art, that the present invention may be practiced without some or all of these specific details.

Figure 1:
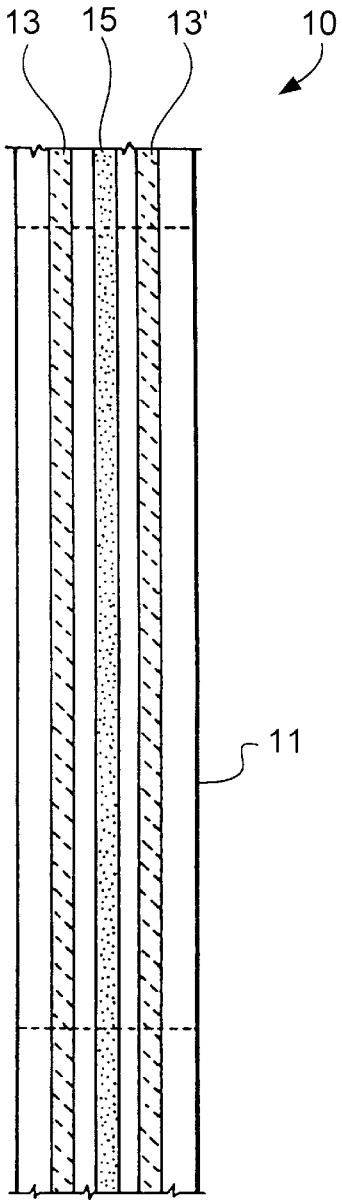
FIG. 1 shows a top view of a mercury dispensing support strip, according to one embodiment of the present invention.

In one embodiment, the present invention includes a mercury dispensing shield, which in turn includes a substantially elongated mercury dispensing support strip having channels into which tracks of a mercury releasing and a getter material are deposited. By way of example, FIG. 1 shows an elongated mercury dispensing support strip 10, according to one embodiment of the present invention. One surface 11 of support strip 10 includes two tracks 13 and 13' of mercury releasing material deposited on either side of one track 15 of a getter material.

Figure 2:
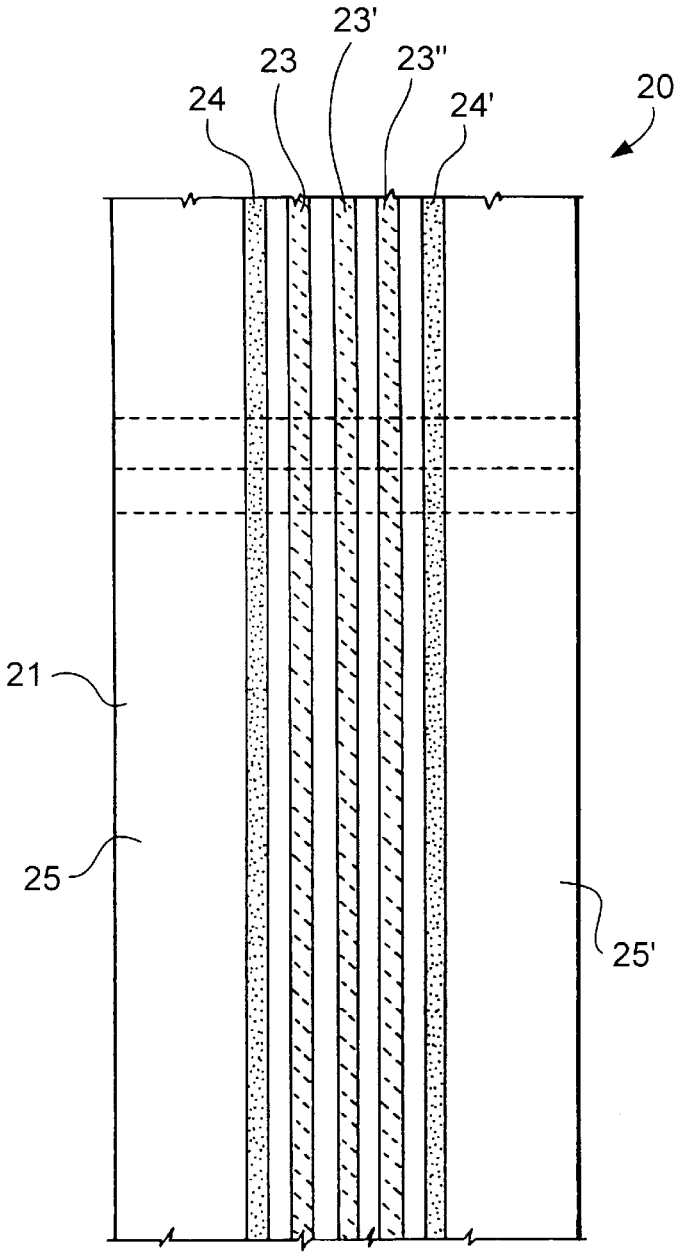
FIG. 2 shows a top view of a mercury dispensing support strip, according to an alternative embodiment of the present invention.

Alternatively, an elongated mercury dispensing support strip 20, according to another embodiment of the present invention is shown in FIG. 2. Support strip 20 has a width that is larger than the width of strip 10 of FIG. 1 and slightly greater than the circumference of the shield to be manufactured. One surface 21 of support strip 20 has disposed about its center tracks 23, 23', and 23" of a mercury releasing material and tracks 24 and 24' of a getter material. At the edges of support strip 20, two areas 25 and 25' of surface 21 are left free of any material tracks. The tracks of the mercury releasing material and the getter material generally have a thickness between about 20 micrometers ($\mu$m) and about 120 $\mu$m. It should be borne in mind, however, that the support strip according to the present invention is not limited to any specific number, orientation or positioning of the tracks. The support strips of FIGS. 1 and 2 are intended as examples of how the tracks of mercury releasing material and the getter material may be employed on a metallic support.

The support strip can be made from various materials suitable for supporting and holding mercury dispensing and getter materials used in the construction and operation of fluorescent lamps. In one embodiment, the support strip comprises an elongated strip of nickel-plated steel as this material combines good mechanical and oxidation resistance properties, which effectively combat oxidation that may occur during the high temperature working steps of the lamp. The support strip may be of any suitable thickness that is capable of retaining sufficient quantities of mercury dispensing and getter materials to effectively dispense mercury and sorb reactive gases. In one embodiment, the support strip has a thickness that is between about 0.1 millimeters (mm) and about 0.3 mm. The width of the support strip, in one embodiment of the present invention may correspond to the height of the final shield, which is generally between about 4 mm and about 6.5 mm, or be slightly larger than the circumference of the designed shield, as shown in FIG. 2, for example.

Figure 3:
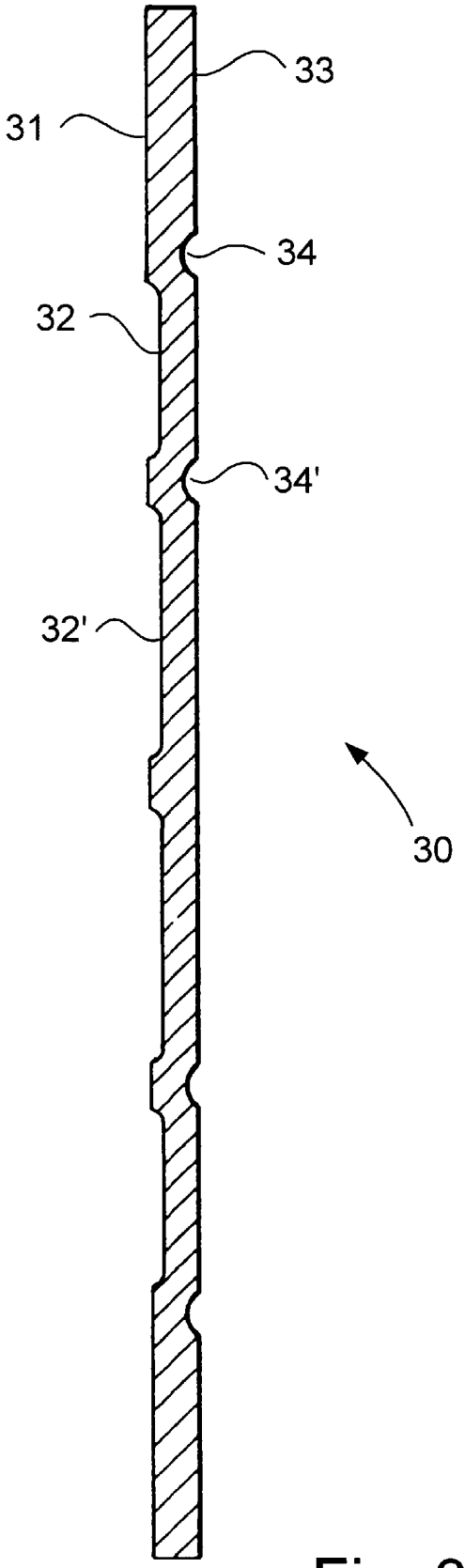
FIG. 3 shows a cross-section of a mercury dispensing support strip, according to one embodiment of the present invention, employed in the production of one embodiment of the inventive shield.

For purposes of illustrating details of interest, FIG. 3 shows a cross-section of a mercury dispensing support strip, according to one embodiment of the present invention, not drawn to scale and having an exaggerated ratio of thickness to width. According to this embodiment, a support strip 30 has on its upper surface 31 longitudinal channels 32 and 32', which are adapted to receive the powder tracks, along the entire length of support strip 30. The lower surface 33 of support strip 30 has longitudinal deformations 34 and 34' adapted for designating or facilitating bending regions of the support strip. Support strip 30 may be employed to construct an embodiment of the shield as detailed below. This or other suitable cross-sections of the support strip may be easily obtained by causing a flat metallic strip to pass between suitably shaped rollers before the step of rolling powders as described below.

The mercury releasing materials are, in one embodiment, intermetallic compounds of mercury with titanium, e.g., $Ti_3Hg$, and/or zirconium, as mentioned in U.S. Pat. No. 3,657,589, in admixture with the copper-based promoting alloys for enhancing mercury release, as described in EP-A-0669639 and EP-A-0691670. Copper based promoting alloys may include, for example, copper tin alloys and copper-silicon alloys. For the preparation and conditions of mercury release, reference may be made to U.S. Pat. No. 3,657,589, EP-A-0669639, and EP-A-0691670, which are incorporated by reference in their entirety and for all purposes. The mercury releasing materials are preferably employed in powdered form with a particle size of between about 100 micrometers ($\mu$m) and about 250 $\mu$m.

The getter material employed is, in one embodiment, St 101 alloy, which includes, as mentioned above, about 84% Zr, 16% Al percent composition by weight. For preparation and conditions of use of the alloy, reference may be made to U.S. Pat. No. 3,203,901, which is incorporated by reference in its entirety for all purposes. Other suitable materials that work well include alloys having the tradename St 707, i.e., about 70% Zr, 24.6% V, 5.4% Fe percent composition by weight, and St 198, i.e., about 76.6% Zr, 23.4% Fe percent composition by weight. Preparation and conditions of utilization of these alloys are described respectively in U.S. Pat. Nos. 4,312,669 and 4,306,887, both of which are also incorporated by reference in their entirety for all purposes. In one embodiment, the particle size of the getter material is between about 100 $\mu$m and about 250 $\mu$m.

According to one embodiment of the present invention, the above-described tracks of materials, as shown in FIGS. 1 and 2, are deposited on the same surface of the support strip by cold-rolling loose powders into channels arranged along one surface of the support strip. During cold rolling, the support strip is typically continuously fed between rollers that cause the powders to adhere to the support strip by cold compression. In order to avoid the abovedescribed problem of so-called "sabre-blade" shaping of the support strip that typically results during rolling of different powders, e.g., mercury releasing and getter material powders, onto the support strip, the present invention provides a method of cold-rolling under conditions effective to exert mechanical strains on the support strip that are substantially symmetric or equal with respect to the central axis of the support strip. As used herein, a "substantially symmetric (or equal) mechanical strain" is that for which the mechanical loads applied to points substantially geometrically symmetric with respect to the central axis of the support strip do not differ in magnitude from each other by more than about 15%.

The above-described symmetric mechanical strain can be provided in various ways. By way of example, in case of an uneven distribution of the powder tracks around the axis of the support strip, an array of narrow rollers may be employed each applying a different load underneath to the support strip section, which may be either covered with a powder track or not. Alternatively, a method for establishing a symmetric strain condition may include depositing the various materials in such a way that the substantially symmetrical tracks formed with respect to the central axis of the support strip consist of materials having a hardness that does not differ from each other by more than about 15%. As is well known in the art, hardness may be measured according to various well known techniques and reported in hardness scales corresponding to the techniques employed. Hardness scales commonly employed for metals are diamond pyramid, Knoop and scleroscope. Under a geometrical aspect, this condition requires that in case of an even number of tracks, the central axis of the support strip should be free from the rolled material, while in the case of an odd number of tracks the central axis of the support strip should coincide with the central axis of one of the material tracks. In one embodiment, the present invention accomplishes the symmetry of hardness by symmetrically depositing even number of tracks of the same material (except for the possible central track) with respect to the central axis of the support strip.

In order to facilitate adhesion of the powder tracks on the strip, techniques that are well known in the art may be employed. By way of example, the support strip surface can be adapted to receive the powder tracks by mechanical treatments to the surface of the support strip. Alternatively, according to another embodiment as shown in FIG. 3, channels that are adapted to receive the powder tracks, may be formed along the entire length of the support strip.

According to one embodiment of the present invention, the above-described support strips having tracks of materials are then cut into pieces and folded to form protective shields. By way of example, in the embodiment shown in FIG. 1, support strip 10 having a width that is substantially equal to the height of the desired shield, may be cut along the dashed lines with a pitch slightly greater than the circumference of the shield. Alternatively, in the embodiment shown in FIG. 2, support strip 20, which may be slightly wider than the designed circumference of the shield, is cut along the dashed lines with a pitch corresponding to the height of the desired shield. In both cases, the pieces may be of rectangular shape and the ratio of one edge to the second edge is between about 5:1 and about 15:1.

In one embodiment, a piece cut from the support strip of the present invention is then bent and closed in a ring-shape by effectively joining the short edges of the piece. By way of example, support strip 30 of FIG. 3 is bent at the longitudinal deformations 34 and 34'. The edges of the support strip may be joined mechanically, e.g., by crimping or welding the joints, to produce the desired shield. The shape of the actual shield to be produced is primarily dictated by the lamp in which the shield will be employed. The amount of material, the number and width of the tracks to be deposited depend primarily on the quantity of mercury releasing material and getter material that are required in different lamps and can be determined using known methods.

Figure 4A:
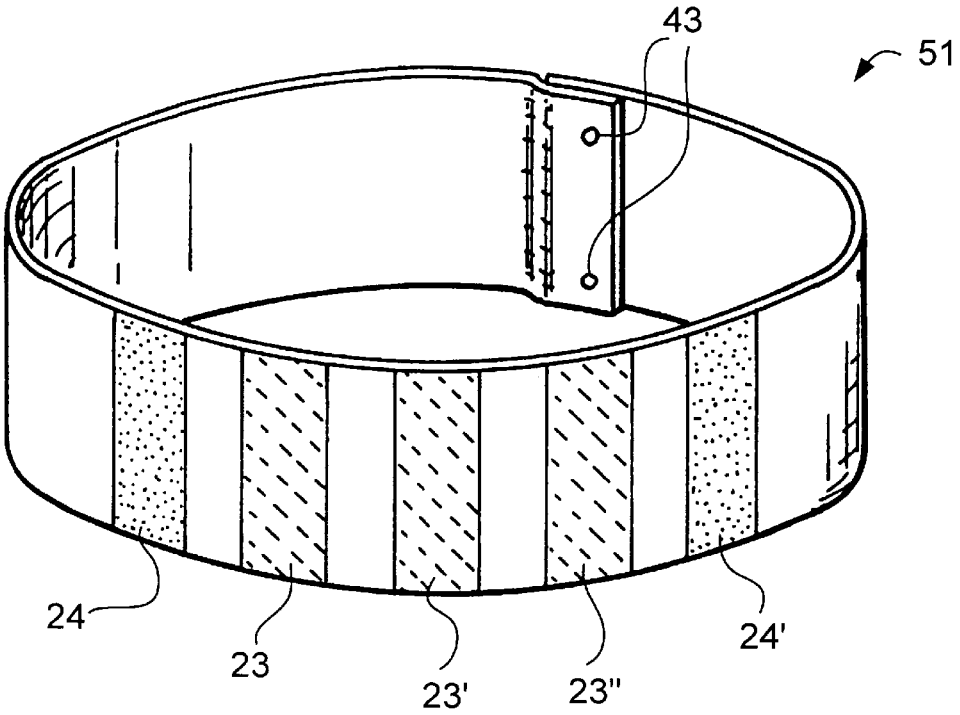
FIG. 4A shows a mercury dispensing device in the form of a shield, according to one embodiment of the present invention, having a substantially circular shape and constructed from the mercury dispensing support strip of FIG. 2.
Figure 4B:
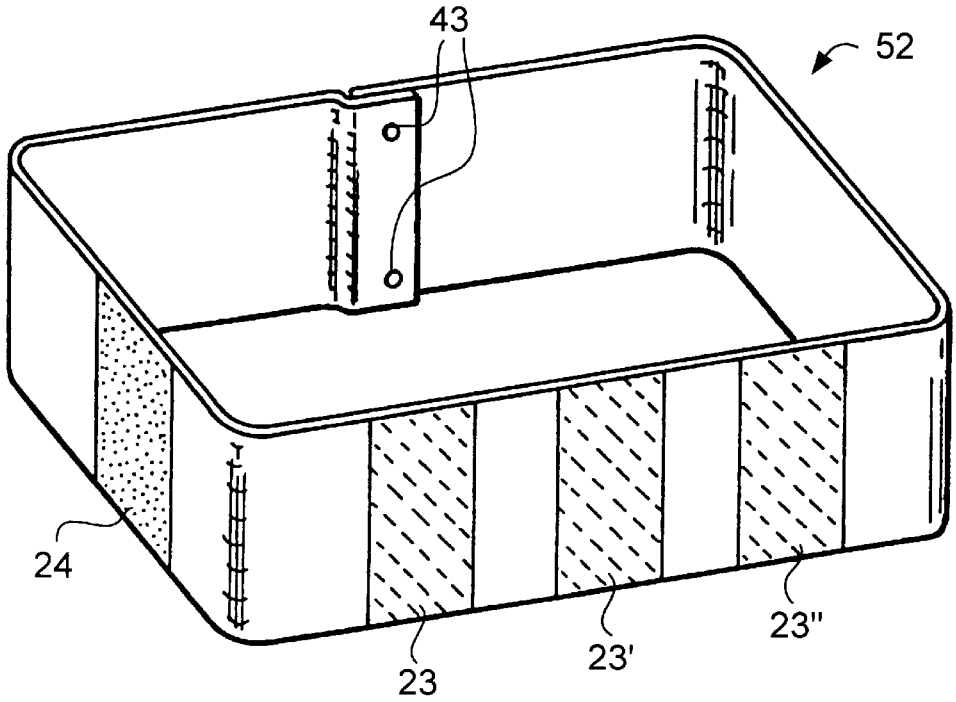
FIG. 4B shows a mercury dispensing device in the form of a shield, according to another embodiment of the present invention, having a substantially rectangular shape and constructed from the mercury dispensing support strip of FIG. 2.

The present invention includes shield cross-sections of various shapes, such as an oval-shape or square cross-section. By way of example, FIGS. 4A and 4B show preferred embodiments of a shield 51 having a circular cross-section and a shield 52 having substantially rectangular crosssection, respectively. The resulting shape of shield 52 having an essentially rectangular crosssection, is often especially useful as it bends the piece of support strip in areas that are free from material tracks and therefore substantially prevents the dislodgment of particles that may be otherwise present at or near the bend.

In one embodiment, the rectangular shield of the present invention as shown in FIG. 4B may be made by starting from a support strip having deformations 34 and 34' but without channels 32 and 32'. In another embodiment the shield of circular cross-section as shown in FIG. 4A may be constructed from a support strip without having deformations 34 and 34' and with or without channels 32 and 32' on the outer side of the shield.

The shield of FIGS. 4A and 4B may be constructed according to one embodiment of the present invention from strip 20 of FIG. 2. Referring back to FIG. 2, two areas 25 and 25' at the support strip edges are kept free from deposits of materials and remain available for the welding step. According to this embodiment, the support strip is cut along the dashed lines of FIG. 2 with a pitch corresponding to the desired height of the shield. The obtained pieces are then bent and welded at welded regions 43 in free areas 25 and 25' to form shields, in which the tracks of the various materials are present on the outer surface of the shield in a direction parallel to the axial direction. The use of the wide support strip of FIG. 2 is useful as it provides a wide, free area for carrying out the welding as well as free areas for welding the shield to the support keeping it in position in the lamp.

Figure 5:
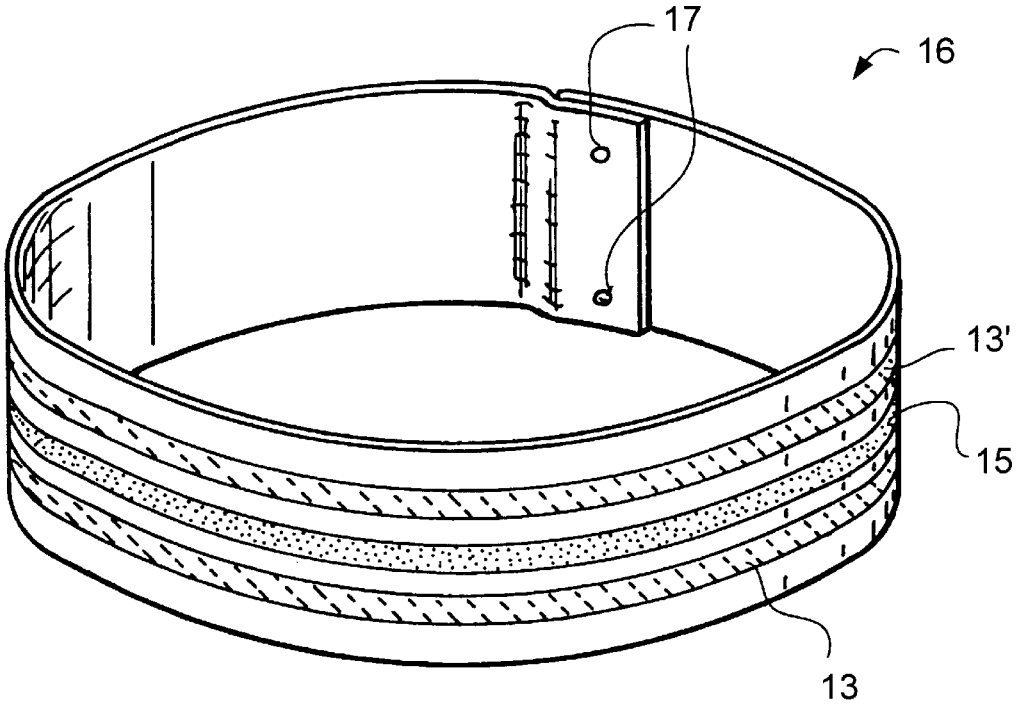
FIG. 5 shows a mercury dispensing device in the form of a shield, according to an alternative embodiment of the present invention, constructed from the mercury dispensing support strip of FIG. 1.

Alternatively, FIG. 5 shows a shield 16 manufactured by using support strip 10 of FIG. 1, wherein the tracks are shown to be deposited in the circumferential direction of the shield. Referring back to FIG. 1, shield 16 can be constructed from a piece of support strip 10 is cut along the dashed lines with a pitch, which is slightly greater than the shield circumference. As mentioned above in the discussion corresponding to FIGS. 4A and 4B, the piece is bent as a ring and spot-welded at points 41 to form a complete shield 40 bearing the tracks 13, 13' and 15 on its outer surface.

Figure 6:
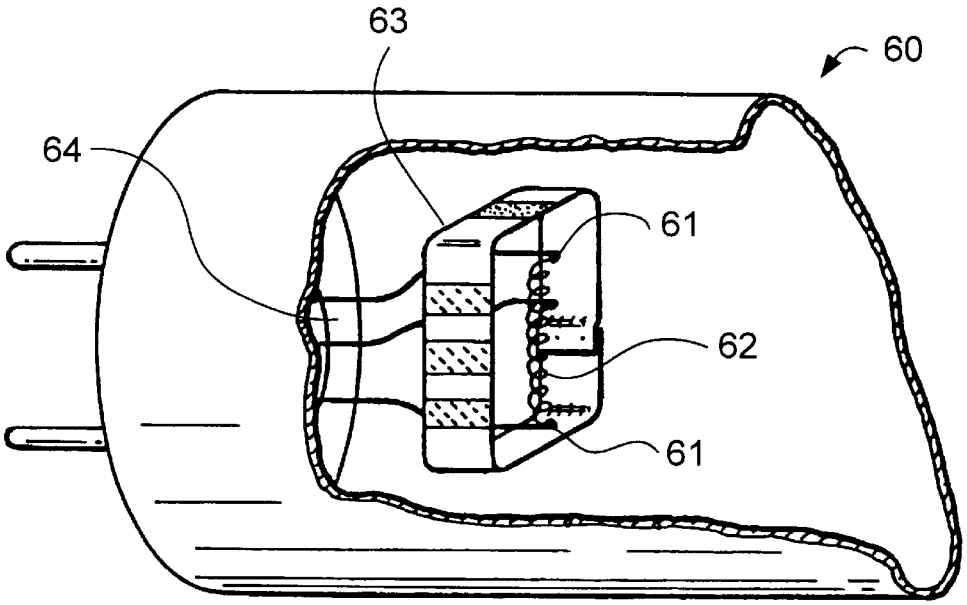
FIG. 6 shows a cut-away view of a lamp having a shield, according to one embodiment of the present the invention, that is mounted about an electrode.

FIG. 6 shows a cut-away view of the end portion of a rectilinear lamp. According to this figure, a shield in accordance with one embodiment of the present invention is shown in its working position. Lamp 60, electric contacts 61 feeding the electrode 62 with electric power and a shield 63 fixed to a support 64 may be assembled as shown.

A typical process that involves the mercury dispensing shield, according to the present invention, begins when lamp 60 is energized to strike a plasma inside lamp 60. The mercury releasing material deposited on shield 63 releases mercury atoms, which are propelled to a higher excitation state by the ions and electrons in the plasma and cause the emission of UV radiation. The phosphors absorb this UV radiation and emit visible light. Any reactive gases, e.g., $O_2H_2O$, CO, $CO_2$, produced during the operation of lamp 60 are absorbed by the getter material deposited on shield 63. Shield 63, positioned in lamp 60, also effectively shields and protects regions of lamp 60 near electrode 62 from direct electronic or ionic bombardment by electrode 62.

The shields of the present invention have many advantages over those of the prior art. By way of example, the shields of the present invention keep the mercury releasing materials separate from the getter materials, and thereby avoid possible interferences between the two materials. As a further example, the shield of the present invention has the materials, i.e., the mercury releasing and the getter material, rolled on a single side of the support and, as a result, avoids the prior art shield design, which as mentioned above, is extremely difficult to manufacture.

While this invention has been described in terms of several preferred embodiments, there are alterations, permutations, and equivalents which fall within the scope of this invention, e.g., the shield of the present invention may be employed in applications, other than the fluorescent lamps. It should also be noted that there are many alternative ways of implementing the methods and apparatuses of the present invention. It is therefore intended that the following claims be interpreted as including all such alterations, permutations, and equivalents as fall within the true spirit and scope of the present invention.

What is claimed:

1. A mercury dispensing support strip capable of dispensing mercury and sorbing reactive gases, said mercury dispensing support strip comprising:

a) at least one track of mercury releasing material deposited on a first surface of said mercury dispensing support strip; and b) at least one track of a getter material deposited on said first surface of said mercury dispensing support strip, such that said tracks of said mercury releasing material and said getter material are pressed into said dispensing support strip a substantially equivalent amount such that said dispensing support strip retains a substantially symmetrical shape with respect to a central axis of the first surface of said mercury dispensing support strip.

2. The mercury dispensing support strip of claim 1, wherein the mechanical strain of said tracks applied to substantially symmetric points with respect to the central axis do not differ by more than about 15%.

3. The mercury dispensing support strip of claim 1, wherein the hardness of said mercury releasing material and said getter material in said tracks that are substantially symmetric with respect to the central axis of said first surface of said mercury dispensing support strip do not differ by more than 15%.

4. The mercury dispensing support strip of claim 1, wherein said first surface of said strip includes longitudinal channels adapted to receive said tracks of said mercury releasing material and said getter material.

5. The mercury dispensing support strip of claim 1, wherein said mercury dispensing support strip further includes a second surface opposite to said first surface, said second surface includes longitudinal deformations to designate bending regions of said mercury dispensing support strip.

6. The mercury dispensing support strip of claim 1, wherein said mercury releasing material comprises of materials selected from the group consisting of intermetallic compounds of mercury and copper based promoting alloys.

7. The mercury dispensing support strip of claim 6, wherein said intermetallic compounds of mercury are selected from the group consisting of titanium based intermetallic compounds and zirconium based intermetallic compounds and said copper based promoting alloys comprises one or more alloys from the group consisting of copper silicon alloys and copper-tin alloys.

8. The mercury dispensing support strip of claim 7, wherein said titanium based intermetallic compound comprises $Ti_3Hg$.

9. The mercury dispensing support strip of claim 1, wherein said mercury releasing material has a particle size of between about 100 $\mu$m and about 250 $\mu$m.

10. The mercury dispensing support strip of claim 1, wherein said getter material comprises one or more alloys selected from the group consisting of alloys having compositions including about 84% Zr-16% Al, alloys having compositions including about 70% Zr-24.6% V-5.4% Fe and alloys having compositions including about 76.6% Zr-23.4% Fe percent composition is by weight.

11. The mercury dispensing support strip of claim 1, wherein said getter material has a particle size of between about 100 $\mu$m and about 250 $\mu$m.

12. The mercury dispensing support strip of claim 1, wherein said mercury dispensing support strip comprises nickel plated steel.

13. The mercury dispensing support strip of claim 1, wherein said mercury dispensing support strip has a thickness of between about 0.1 mm and about 0.3 mm.

14. The mercury dispensing support strip of claim 1, wherein said mercury dispensing support strip has a height of between about 4 mm and about 6.5 mm.

15. A mercury dispensing shield capable of dispensing mercury, sorbing reactive gases and electrode shielding in a fluorescent lamp, said shield comprising:

c) a ring shaped support including a first surface having a central axis; and d) at least one track of a mercury releasing material and a getter material deposited on said first surface such that said tracks of said mercury releasing material and said getter material exert substantially equal mechanical strains on points of said mercury dispensing shield that are substantially symmetric with respect to the central axis of said first surface of said mercury dispensing shield.

16. The mercury dispensing shield of claim 15, wherein the mechanical strain of said tracks applied to substantially symmetric points with respect to the central axis do not differ by more than about 15%.

17. The mercury dispensing shield of claim 15, wherein the shape of said mercury dispensing shield comprises one selected from the group consisting of oval, square cross-section, rectangular cross-section and circular cross-section.

18. The mercury dispensing shield of claim 15, wherein the shape of said mercury dispensing shield is rectangular cross-section or circular cross-section.

19. The mercury dispensing shield of claim 15, wherein said ring shaped support further includes a second surface opposite to said first surface, said second surface includes longitudinal deformations to facilitate the bending regions of said mercury dispensing shield.

20. The mercury dispensing shield of claim 15, wherein said first surface of said mercury dispensing shield includes longitudinal channels adapted to receive said materials.

21. The mercury dispensing shield of claim 15, wherein the first surface is an outer surface of said mercury dispensing shield.

22. The mercury dispensing shield of claim 15, further comprising a welded region formed in an area free of said tracks of said materials, wherein said welded region joins two edges of a mercury dispensing support strip such that a ring-shaped mercury dispensing shield in formed.

23. The mercury dispensing shield of claim 22, wherein the width of said mercury dispensing support strip is substantially same as the height of said mercury dispensing shield.

24. The mercury dispensing shield of claim 22, wherein the width of said mercury dispensing support strip is greater than the height of said mercury dispensing shield.

25. The mercury dispensing shield of claim 15, wherein said one or more tracks of a mercury releasing material and a getter material are deposited on said first surface in a direction parallel to the axial direction of said mercury dispensing shield.

26. The mercury dispensing shield of claim 15, wherein said one or more tracks of a mercury releasing material and a getter material are deposited on said first surface in the circumferential direction of said mercury dispensing shield.

27. A mercury dispensing support strip capable of dispensing mercury and sorbing reactive gases, said mercury dispensing support strip comprising:

a) at least one track of mercury releasing material deposited on a first surface of said mercury dispensing support strip; and b) at least one track of a getter material deposited on said first surface of said mercury dispensing support strip such that said tracks of said mercury releasing material and said getter material exert mechanical strains on points of said mercury dispensing support strip that are substantially symmetric with respect to a central axis of said first surface of said mercury dispensing support strip.

* * * * *

UNITED STATES PATENT AND TRADEMARK OFFICE

CERTIFICATE OF CORRECTION

PATENT NO. : 6,107,737
DATED : August 22, 2000
INVENTOR(S) : Massimo della Porta It is certified that error appears in the above-identified patent and that said Letters Patent is hereby corrected as shown below:

Title page,
Item [30], under Foreign Priority Data, reads:
"Nov. 23, 1995 [IT] Italy ……...MI95A2435"
it should read: -- Nov. 23, 1995 [IT] Italy……..MI95A002435 --;

Column 7,
Line 18, reads "by cold compression. In order to avoid the abovedescribed". it should read -- by cold compression. In order to avoid the above described --;

Column 8,
Line 32, reads "lar crosssection, respectively. The resulting shape of shield". it should read -- lar cross section, respectively. The resulting shape of shield --;
Line 33, reads "52 having an essentially rectangular crosssection, is often". it should read -- 52 having an essentially rectangular cross section, is often --;

Column 9,
Line 55, reads "first surface of said mercury dispensing support strip,". it should read -- first surface of said mercury dispensing support strip --;

Signed and Sealed this

Twentieth Day of August, 2002

*Attest:*

*Attesting Officer*

JAMES E. ROGAN
*Director of the United States Patent and Trademark Office*